US010637188B2

(12) United States Patent
Schmidt

(10) Patent No.: US 10,637,188 B2
(45) Date of Patent: Apr. 28, 2020

(54) ELECTRICAL PLUG CONNECTOR

(71) Applicant: Aptiv Technologies Limited, St. Michael (BB)

(72) Inventor: Rainer Schmidt, Nuremberg (DE)

(73) Assignee: Aptiv Technologies Limited (BB)

( * ) Notice: Subject to any disclaimer, the term of this patent is extended or adjusted under 35 U.S.C. 154(b) by 0 days.

(21) Appl. No.: 16/208,607

(22) Filed: Dec. 4, 2018

(65) Prior Publication Data

US 2019/0181585 A1 Jun. 13, 2019

(30) Foreign Application Priority Data

Dec. 7, 2017 (EP) ..... 17205961

(51) Int. Cl.

| | |
|---|---|
| ***H01R 13/40*** | (2006.01) |
| ***H01R 13/627*** | (2006.01) |
| ***H01R 13/436*** | (2006.01) |
| ***H01R 13/426*** | (2006.01) |
| ***H01R 13/52*** | (2006.01) |
| ***H01R 43/26*** | (2006.01) |

(52) U.S. Cl.

CPC ..... *H01R 13/627* (2013.01); *H01R 13/426* (2013.01); *H01R 13/4365* (2013.01); *H01R 13/5202* (2013.01); *H01R 43/26* (2013.01); *H01R 13/5219* (2013.01); *H01R 2201/26* (2013.01)

(58) Field of Classification Search

CPC ..... H01R 13/193; H01R 13/4223; H01R 23/7073; H01R 13/426; H01R 13/4362

USPC ..... 439/265, 595, 660, 744, 752, 752.5

See application file for complete search history.

(56) References Cited

U.S. PATENT DOCUMENTS

| | | | | |
|---|---|---|---|---|
| 5,389,014 A * | 2/1995 | Kumpel | ..... | H01R 13/4362 439/595 |
| 6,083,057 A * | 7/2000 | Annecke | ..... | H01R 13/4362 439/752 |
| 6,123,574 A * | 9/2000 | Matsuda | ..... | H01R 13/4223 439/488 |

(Continued)

FOREIGN PATENT DOCUMENTS

| | | |
|---|---|---|
| EP | 1235306 A2 | 8/2002 |
| EP | 3252875 A1 | 12/2017 |

(Continued)

*Primary Examiner* — Thanh Tam T Le

(74) *Attorney, Agent, or Firm* — Robert J. Myers

(57) ABSTRACT

An electrical plug connector includes a plug housing having a wall with a first opening. A contact element holder surrounds the first opening. A collar extends from the wall, surrounding the contact element holder. A fixing element is detachably attached to the contact element holder and radially surrounds the contact element holder and part of the contact element holder. First protrusions project from the fixing element between the fixing element and the collar. Second protrusions project from an inner surface of the fixing element into the contact element holder. The first protrusions and the second protrusions are designed in so that after fitting the plug housing together with a mating plug housing, a collar of the mating plug housing engages the first protrusions, whereby the first protrusions are pressed inwards and whereby the second protrusions are pressed inwards against an electrical contact element held in the contact element holder.

18 Claims, 7 Drawing Sheets

(56) References Cited

U.S. PATENT DOCUMENTS

| | | | | |
|---|---|---|---|---|
| 6,186,813 | B1 * | 2/2001 | Tomita | H01R 13/4364 439/271 |
| 6,537,108 | B2 * | 3/2003 | Sasaki | H01R 13/4364 439/595 |
| 6,913,494 | B2 * | 7/2005 | Ward | H01R 13/4365 439/352 |
| 8,231,409 | B2 * | 7/2012 | Lebrun | H01R 13/4365 439/595 |
| 8,974,243 | B2 * | 3/2015 | Friese | H01R 13/4367 439/374 |
| 8,979,599 | B2 * | 3/2015 | Hautbois | H01R 13/4362 439/752 |
| 9,017,111 | B2 * | 4/2015 | Zheng | H01R 13/4223 439/595 |
| 9,640,905 | B2 * | 5/2017 | Suzuki | H01R 13/6271 |
| 2010/0055961 | A1 | 3/2010 | Martin et al. | |
| 2016/0197440 | A1 | 7/2016 | Suzuki | |

FOREIGN PATENT DOCUMENTS

| | | | |
|---|---|---|---|
| EP | 3252876 | A1 | 12/2017 |
| WO | 2013013967 | A1 | 1/2013 |

* cited by examiner

ELECTRICAL PLUG CONNECTOR

CROSS-REFERENCE TO RELATED APPLICATION

This application claims the benefit under 35 U.S.C. § 119(a) of Patent Application No. 17205961.0 filed in the European Patent Office on Dec. 7, 2017, the entire disclosure of which is hereby incorporated by reference.

TECHNICAL FIELD OF THE INVENTION

The invention relates to an electrical plug connector and a method for fitting the electrical plug connector to a mating connector.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
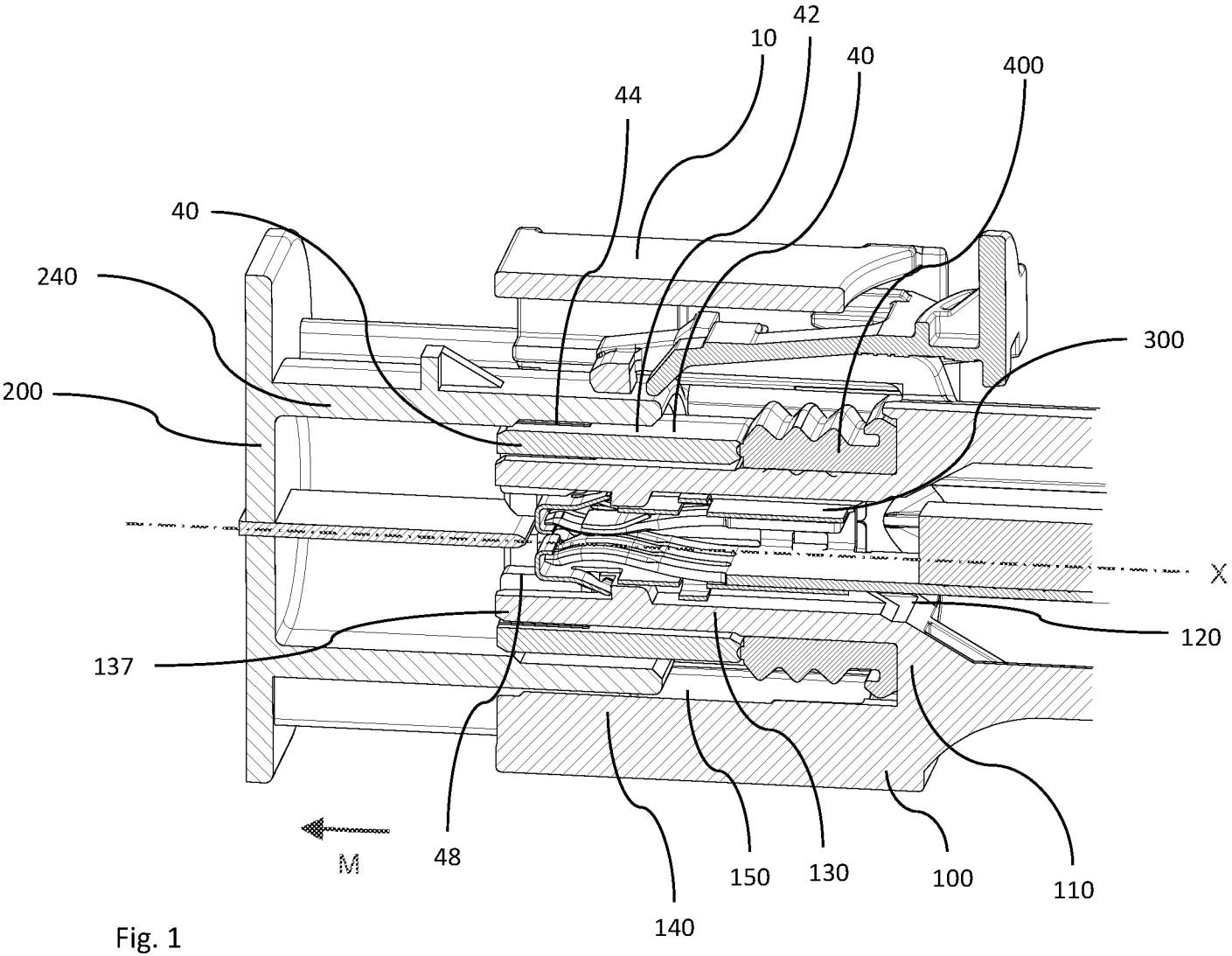
FIG. 1 is a cross-section view of an electrical plug connector in accordance with an embodiment of the invention.

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

An electrical plug connector contains a plug housing having a wall which defines a first opening. A sleeve-like contact element holder surrounds the first opening along a longitudinal axis in a plug-in direction. The contact element holder is designed for receiving and holding an electrical contact element. A collar extends from the wall in the plug-in direction along the longitudinal axis and surrounds the contact element holder at a distance. A sleeve-like fixing element is attached releasably to the contact element holder.

The fixing element surrounds the contact element holder radially. The fixing element surrounds at least a part of the contact element holder along the longitudinal axis. A plurality of first protrusions project from an outer surface of the fixing element into a free space between the fixing element and the collar. A plurality of second protrusions project from an inner surface of the fixing element through a plurality of second openings into the contact element holder. The first protrusions and the second protrusions are designed so that, after fitting the plug housing together with a mating plug housing, a counter collar of the mating plug housing extends into the free space and is in engagement with the first protrusions. This causes the first protrusions to be pressed inwardly and the second protrusions to be pressed inwardly. The second protrusions are also pressed against an electrical contact element that is held in the contact element holder.

A fixing element is provided which, when the electrical plug connector is not inserted, is attached loosely around the contact element holder so that when mounting the electrical contact element, no problems occur through obstructions which project into the contact chamber, and thus mounting the contact can be carried out with comparatively little force. The inside of the contact chamber is slightly larger than the external dimensions of the electrical contact element so that the electrical contact element has a small amount of play in the contact chamber and can be easily inserted therein as a result. The fixing element is flexible in design so that mounting the electrical contact element can be carried out in each case with little force although the clearance between the protruding elements already has the same size as the external dimensions of the contact element. Once the mounting of the electrical contact element has taken place the electrical plug connector of the invention can be fitted together with a mating connector. The collar of the mating connector deforms the fixing element so that protrusions which are attached to the fixing element project into the contact chamber and press against the contact element. The play exhibited by the contact element in the contact chamber is thereby eliminated. The contact element is now, even in the case of severe vibrations, held firmly fixed between the protrusions. The wear or damage caused by vibrations is thus minimized.

The contact element holder preferably comprises a sleeve-like fixing element and the collar preferably has a circular or oval cross-section. A circular or oval structure requires comparatively simple injection moulding tools. Sliding on the fixing element is particularly simple with this cross-section. The collar of the mating connector likewise has a circular or oval cross-section so that, after fitting together, the parts lie concentrically around the electrical contact element. This structural shape enables the development of compact electrical plug connector systems.

The inner diameter of the fixing element is particularly preferably larger than the outer diameter of the contact element holder and the outer diameter of the fixing element is smaller than the inner diameter of the collar. Through this structure the fixing element can be easily mounted and has enough space to be able to be deformed.

The fixing element is preferably flexibly deformable in the radial direction in relation to the longitudinal axis. Through the flexible deformability the protrusions can be moved flexibly in the direction of the contact element and vice versa. The electrical plug connector can thereby be fitted and released many times without the fixing element losing its function.

In a particularly preferred embodiment the wall thickness of the fixing element varies along the periphery of the fixing element. By varying the wall thickness the behaviour of the fixing element can be influenced in relation to its flexibility. The fixing element consists of plastic and is made in an injection moulding process. Areas with a reduced wall thickness are less resistant to deformation and can be deformed flexibly up to a certain degree. Through the deliberate distribution of areas with increased wall thickness and reduced wall thickness it is possible to adjust the flexibility of the fixing element, more particularly in the radial direction.

The areas of the fixing element from which first protrusions and/or second protrusions originate preferably have a greater wall thickness. A greater wall thickness makes the areas of the fixing element more rigid and more inflexible. The areas where the protrusions are attached have to transfer forces and therefore have to be more rigid.

In each case one first protrusion and one second protrusion preferably extend counter to one another and at right angles to the outer surface of the fixing element, along a common axis, away from one another. With this arrangement of the protrusions the force which the counter collar exerts on the first protrusions is transferred in a line to the second protrusions. Undesired tensions or deformations inside the fixing element are thereby avoided.

In a particularly preferred embodiment the first protrusions and the second protrusions are arranged uniformly along the periphery of the fixing element. Through this arrangement of the protrusions the fixing element is deformed evenly along the periphery and the electrical contact element is supported evenly along its periphery.

The first protrusions are preferably smaller than the second protrusions. The first protrusions should project as little as possible into the free space in order not to unnecessarily increase the structural size of the electrical plug connection and not impair the seal in its sealing function. The first protrusions can be designed in all conceivable forms, for example, as bulges or ribs. The size of the protrusions which extend radially from the surface of the fixing element corresponds roughly to the play of the electrical contact element in the contact element chamber.

The contact element holder preferably has a contact element chamber for holding the electrical contact element, wherein the inside of the contact element chamber is free of second protrusions. When the electrical plug connector is not in the fitted state no protrusions project into the contact element chamber so that the electrical contact element can be inserted and removed easily. The electrical contact element, during the process of fitting together with the mating plug, can furthermore be aligned in relation to a complementary electrical contact element at least at the start of the process. Small tolerances of the electrical plug connector can thereby be compensated. As soon as the counter collar comes into engagement with the first protrusions and thereby presses the second protrusions against the electrical contact element, the electrical contact element can no longer be moved.

In a particularly preferred embodiment the second protrusions are designed in the manner of ribs and the second openings are designed in the manner of slits wherein the slits extend from the free end of the contact element holder counter to the plug-in direction. This structure makes assembly particularly simple because the positioning of the fixing element is visible through the slits and ribs. The ribs are securely guided in the slits during movement.

An electrical contact element is preferably held in the contact element holder wherein the electrical contact element has a rectangular cross-section and wherein the contact element holder is designed to hold the electrical contact element in relation to the longitudinal axis with restricted rotation relative to the longitudinal axis. The design of the electrical contact element with a box-like structure is widespread in technology when the mating plug connector is fitted with flat blades. In order to fix this design of the electrical contact element only four protrusions are required.

The electrical contact element preferably has four side faces wherein each side face of the electrical contact element is arranged in each case opposite a second protrusion of the fixing element. With the arrangement of the protrusions opposite the side faces it is ensured that the retaining force acts directly on the side face. In practice protrusions and side faces are arranged so that they are at right angles to one another.

In a particularly preferred embodiment a ring-shaped sealing element which surrounds the contact element holder is arranged between the wall and the fixing element wherein the fixing element holds the ring-shaped sealing element in position. The fixing element holds a ring-shaped sealing element in position by its end opposite the plug-in direction. The fixing element thus serves as a safeguard against losing the ring-shaped sealing element during transport. It is particularly preferred if the outer diameter of the fixing element is slightly smaller than the outer diameter of the sealing element in order not to impair the sealing action thereof.

The fixing element preferably has retaining arms which interact with retaining openings in the contact element holder in order to hold the fixing element on the contact element holder. A particularly simple manner of fastening the fixing element on the contact element holder uses retaining arms which are introduced with retaining openings in the contact element holder. It is however also conceivable to reverse the position of the arms and openings. In principle all conceivable snap-fitting or detent connections can be used where technically possible.

A process for fitting together an electrical plug connector and an electrical mating connector is particularly preferred. The process comprises the following method steps:

- providing an electrical plug connector and an electrical mating connector;
- moving the electrical plug connector along a longitudinal axis in a plug-in direction to the electrical mating connector;
- introducing a counter collar of a mating plug housing of the mating connector of the electrical plug connector;
- moving inwards first protrusions, projecting into the free space, with the counter collar;
- deforming a sleeve-like fixing element through the first protrusions attached to the fixing element;
- moving inwards second protrusions which are attached on the fixing element so that the second protrusions project into the inside of a contact element holder;
- clamping an electrical contact element, which is held in the contact element holder, with the second protrusions.

Preferred configurations of the invention will now be described below in further detail. Similar or corresponding details of the object according to the invention are provided with the same reference numerals.

FIG. 1 shows an electrical plug connector 10 in a sectional view. The electrical plug connector 10 comprises a plug housing 100 and a wall 110 which has a first opening 120. A sleeve-like contact element holder 130, designed for receiving and holding an electrical contact element 300, extends in the plug-in direction M from the wall 110, surrounding the first opening 120, along a longitudinal axis X. A collar 140 extends in the plug-in direction M from the wall 110, surrounding the contact element holder 130 at a distance 142, along the longitudinal axis X. A sleeve-like fixing element 40 is detachably attached to the contact element holder 130. The fixing element 40 radially encloses the contact element holder 130. The fixing element 40 at least along a portion of the contact element holder 130 surrounds the contact element holder 130 along the longitudinal axis X. A plurality of first protrusions 44 project from an outer surface 42 of the fixing element 40 into a free space 150 between the fixing element 40 and the collar 140. A plurality of second protrusions 48 project from an inner surface 46 of the fixing element 40 through a plurality of second openings 132 into the contact element holder 130.

Figure 2:
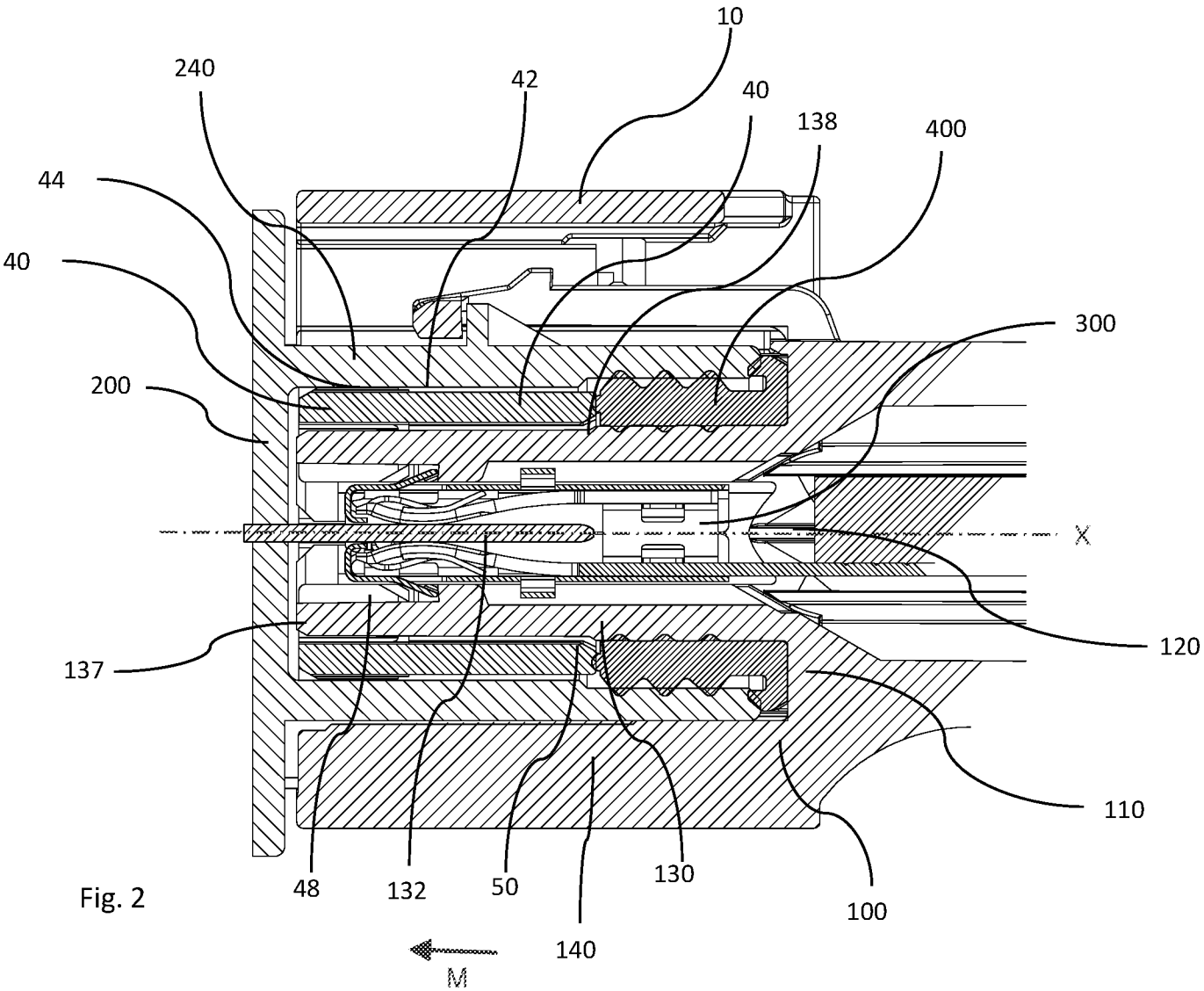
FIG. 2 is a cross-section view of the electrical plug connector in the fitted state in accordance with an embodiment of the invention.

FIG. 2 shows an electrical plug connector of the invention in a sectional view in the fitted state. The first protrusions 44 and the second protrusions 48 are designed in such a way that after fitting the plug housing 100 together with the mating plug housing 200 a counter collar 240 of the mating plug housing 200 extends into the free space 150 and engages there with the first protrusions 44 whereby the first protrusions 44 are pressed inwards and whereby the second protrusions 48 are pressed inwards. The second protrusions 48 are thereby pressed against an electrical contact element 300 held in the contact element holder 130. A ring-shaped sealing element 400, surrounding the contact element holder 130, is arranged between the wall 110 and the fixing element 40. The fixing element 40 has retaining arms 50 which interact with retaining openings 138 in the contact element holder 130 in order to hold the fixing element 40 on the contact element holder 130.

Figure 3B:
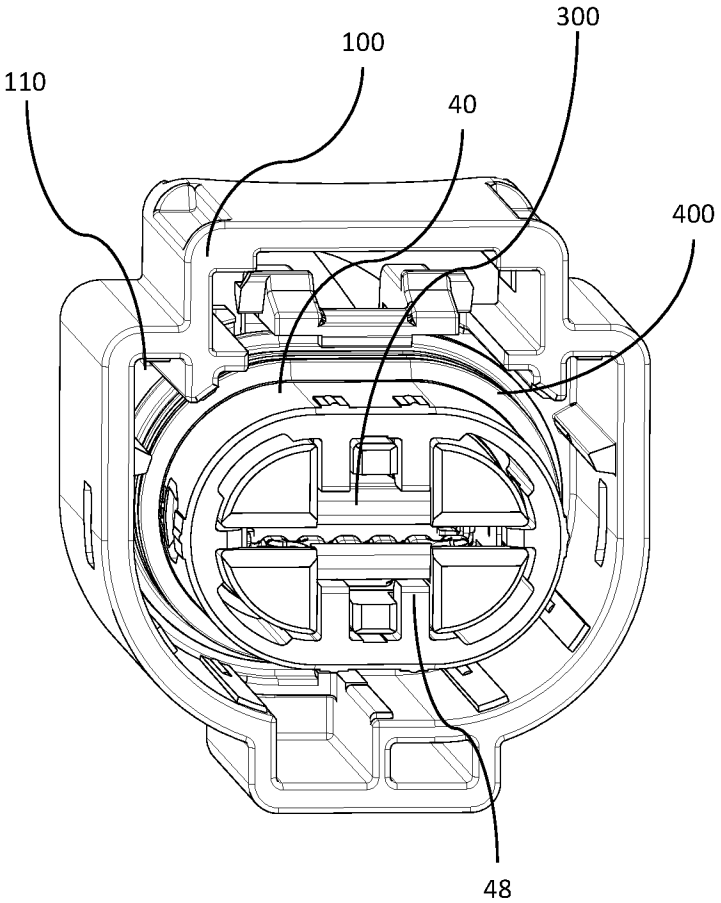
FIGS. 3*a* and 3*b* are perspective views of a the plug housing of the electrical plug connector counter to the insert direction in accordance with an embodiment of the invention.
Figure 3A:
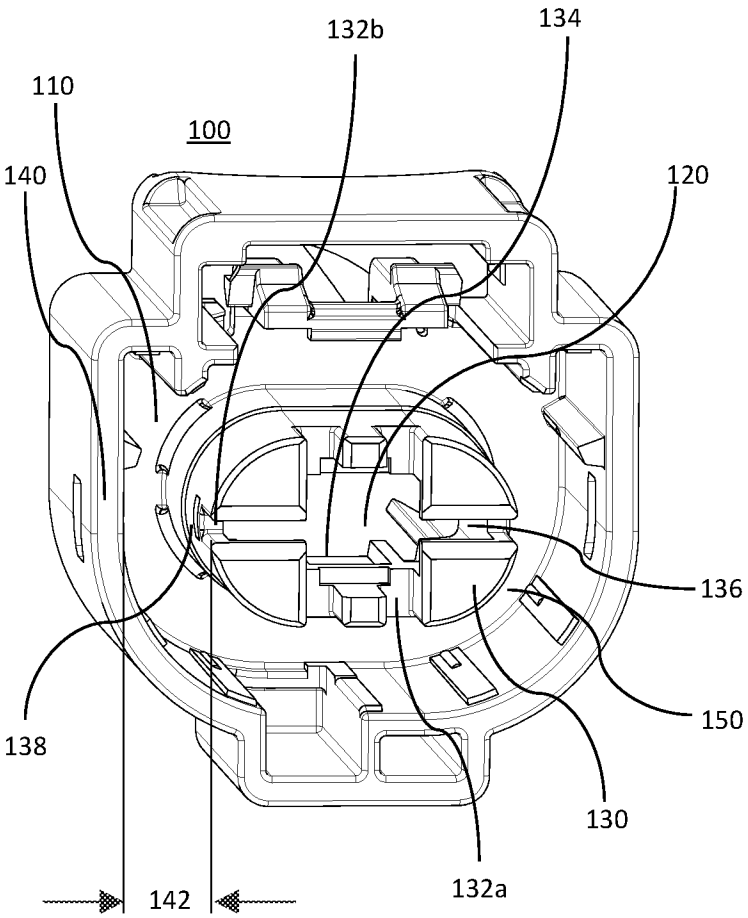

FIG. 3*a* shows the plug housing 100 of the electrical plug connector of the invention in a perspective view, counter to the plug-in direction. The contact element holder 130 and the collar 140 have a circular or oval cross-section. The contact element holder 130 has a contact element chamber 134 for holding the electrical contact element 300. The contact element holder 130 furthermore has retaining openings 138 as well as slit-like second openings 132, divided into vertical openings 132*a* and horizontal openings 132*b*.

FIG. 3*b* shows the plug housing of the electrical plug connector of the invention in a perspective view counter to the plug-in direction. The fixing element 40 has an oval cross-section. The inside of the contact element chamber 134 is free of second protrusions 48 when the electrical plug connector is not fitted together with the mating plug connector. The electrical contact element 300 is thus in contact with the second protrusions 48 but is not restricted in movement.

Figure 4:
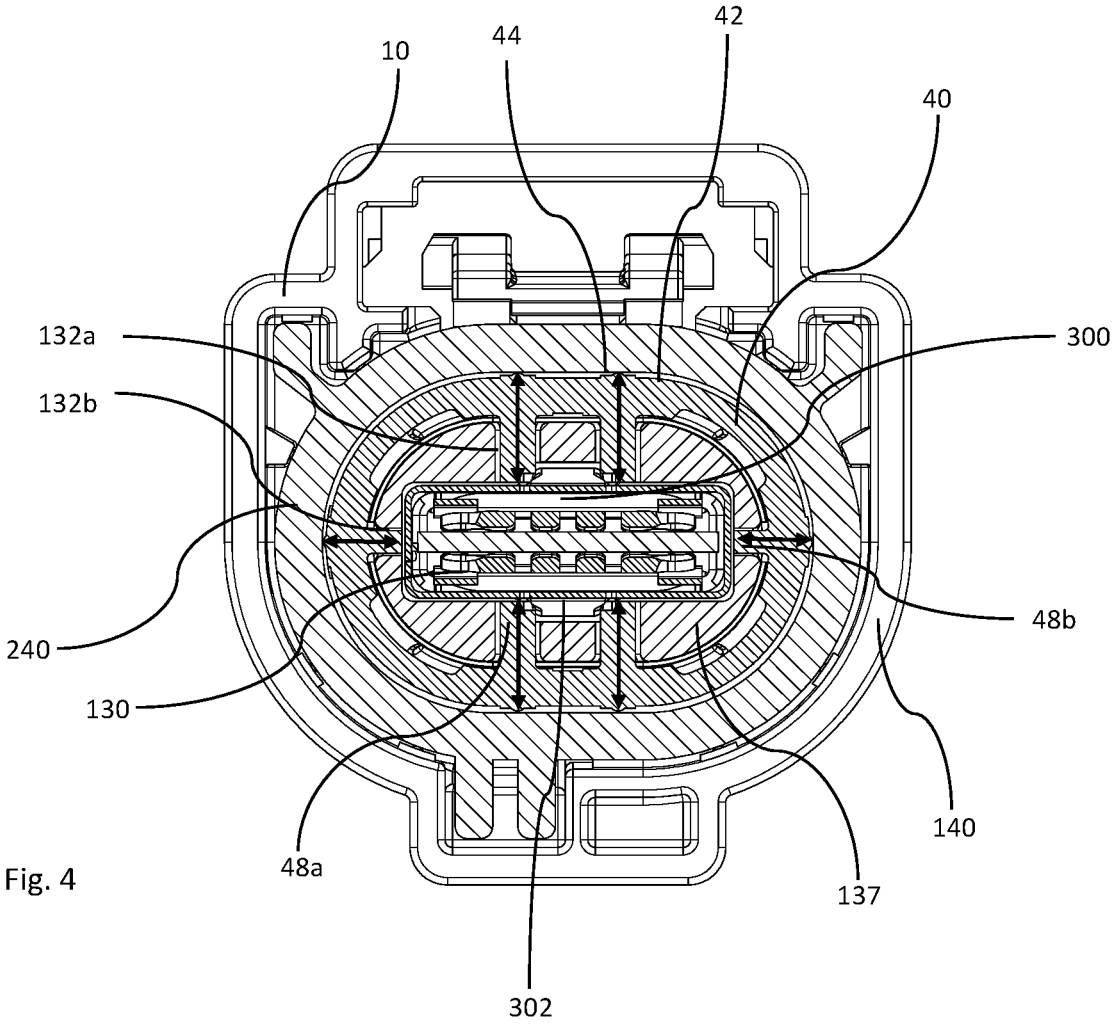
FIG. 4 is a cross-section view of the electrical plug connector in the fitted state in accordance with an embodiment of the invention.

FIG. 4 shows a sectional view of the electrical plug-in connector of the invention in the fitted state, wherein the section runs transversely to the longitudinal axis. The internal diameter of the fixing element 40 is greater than the external diameter of the contact element holder 130. The external diameter of the fixing element 40 is smaller than the internal diameter of the collar 140. The second protrusions 48 are designed as ribs and divided into vertical protrusions 48*a* and horizontal protrusions 48*b*. The second openings 132 are designed as slits and are divided into vertical openings 132*a* and horizontal openings 132*b*. The vertical protrusions 48*a* and the horizontal protrusions 48*b* are placed in their corresponding vertical openings 132*a* and horizontal openings 132*b* respectively. The slits 136 extend from the free end 137 of the contact element holder 130 counter to the plug-in direction M. An electrical contact element 300 is held in the contact element holder 130. The electrical contact element 300 has a rectangular cross-section. The contact element holder 130 is designed to hold the electrical contact element 300 restricted in its freedom of movement in relation to the longitudinal axis X. The electrical contact element 300 has four side faces 302 wherein each side face 302 of the electrical contact element 300 is arranged respectively opposite a second protrusion 48 of the fixing element 40.

Figure 5:
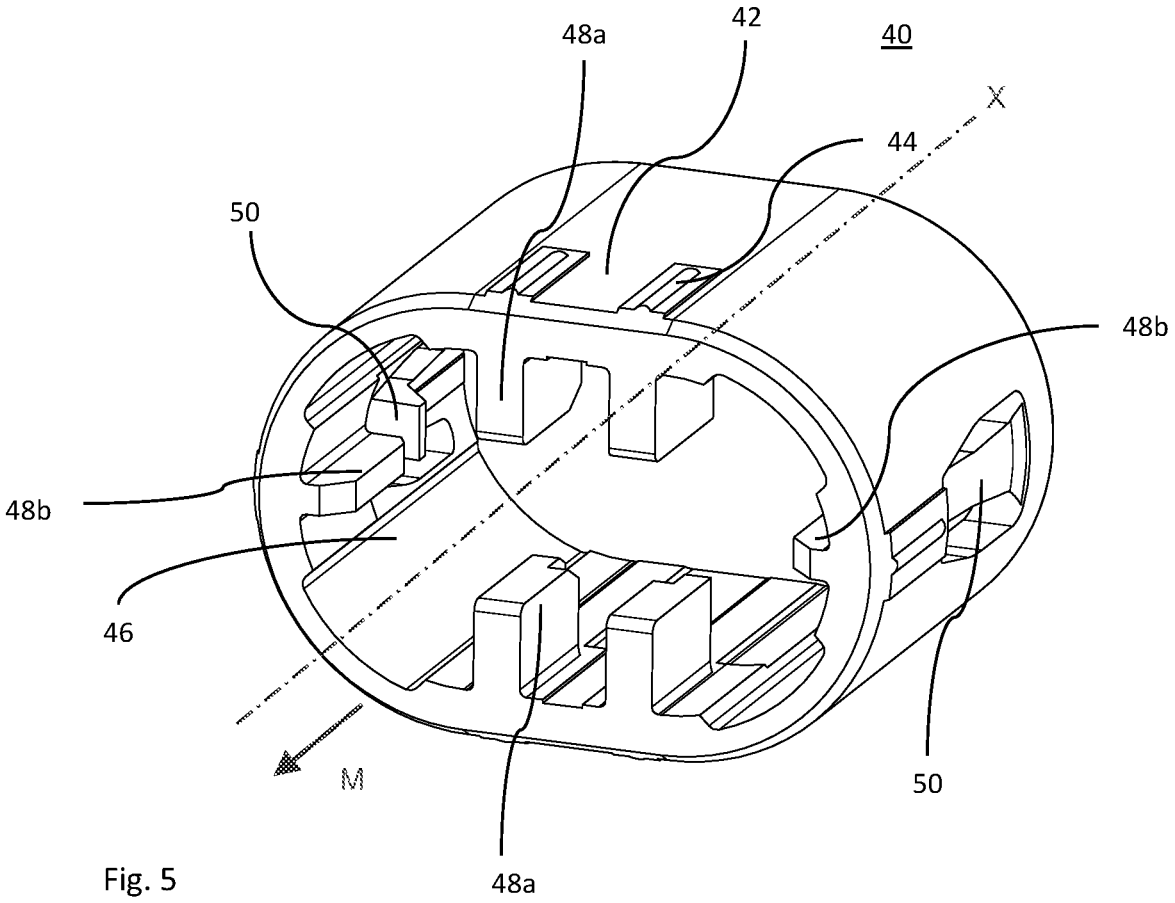
FIG. 5 is a perspective view of the fixing element in accordance with an embodiment of the invention.
Figure 6:
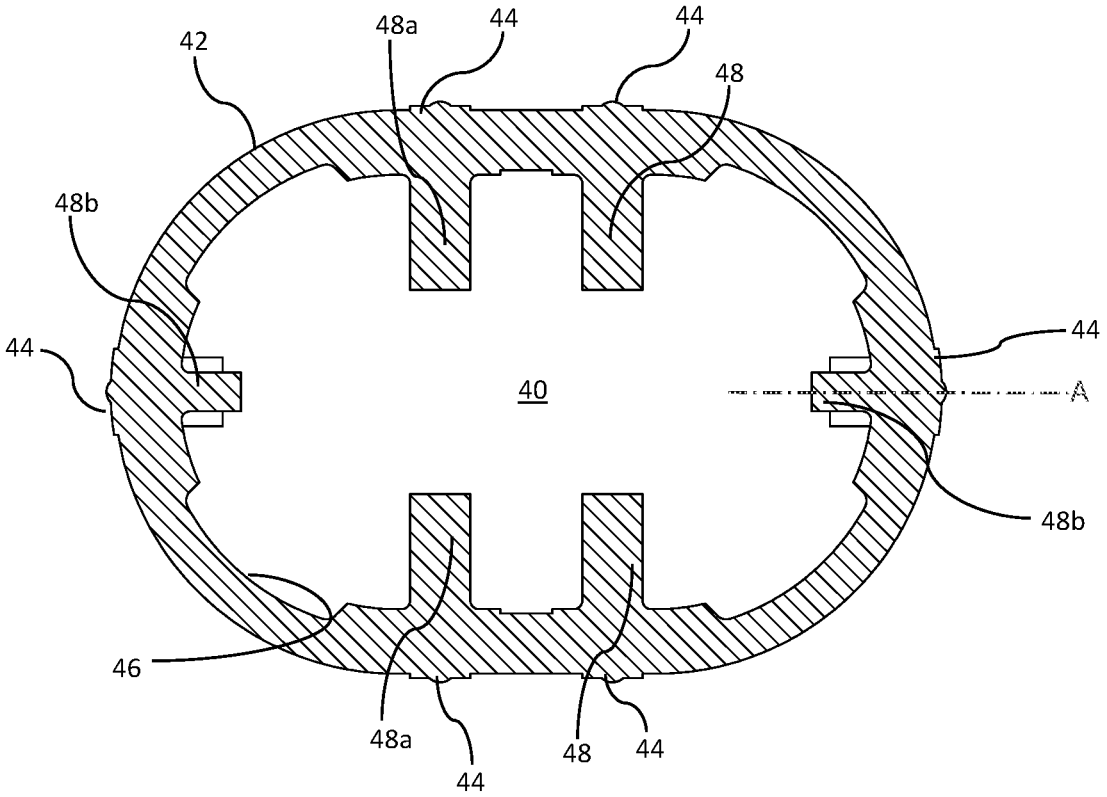
FIG. 6 is a cross-section view of the fixing element perpendicular to the longitudinal axis in accordance with an embodiment of the invention.

FIGS. 5 and 6 show details of the fixing element 40 wherein the section in FIG. 6 runs transversely to the longitudinal axis. The wall thickness of the fixing element 40 varies along the periphery of the fixing element 40. The areas of the fixing element 40 from which first protrusions 44 and/or second protrusions 48 originate have a greater wall thickness. In each case one first protrusion 44 and one second protrusion 48 extend counter to one another and away from one another at right angles to the outer surface 42 of the fixing element 40 along a common axis A. The first protrusions 44 and the second protrusions 48 are arranged uniformly along the periphery of the fixing element 40. The first protrusions 44 are smaller than the second protrusions 48.

Figure 7:
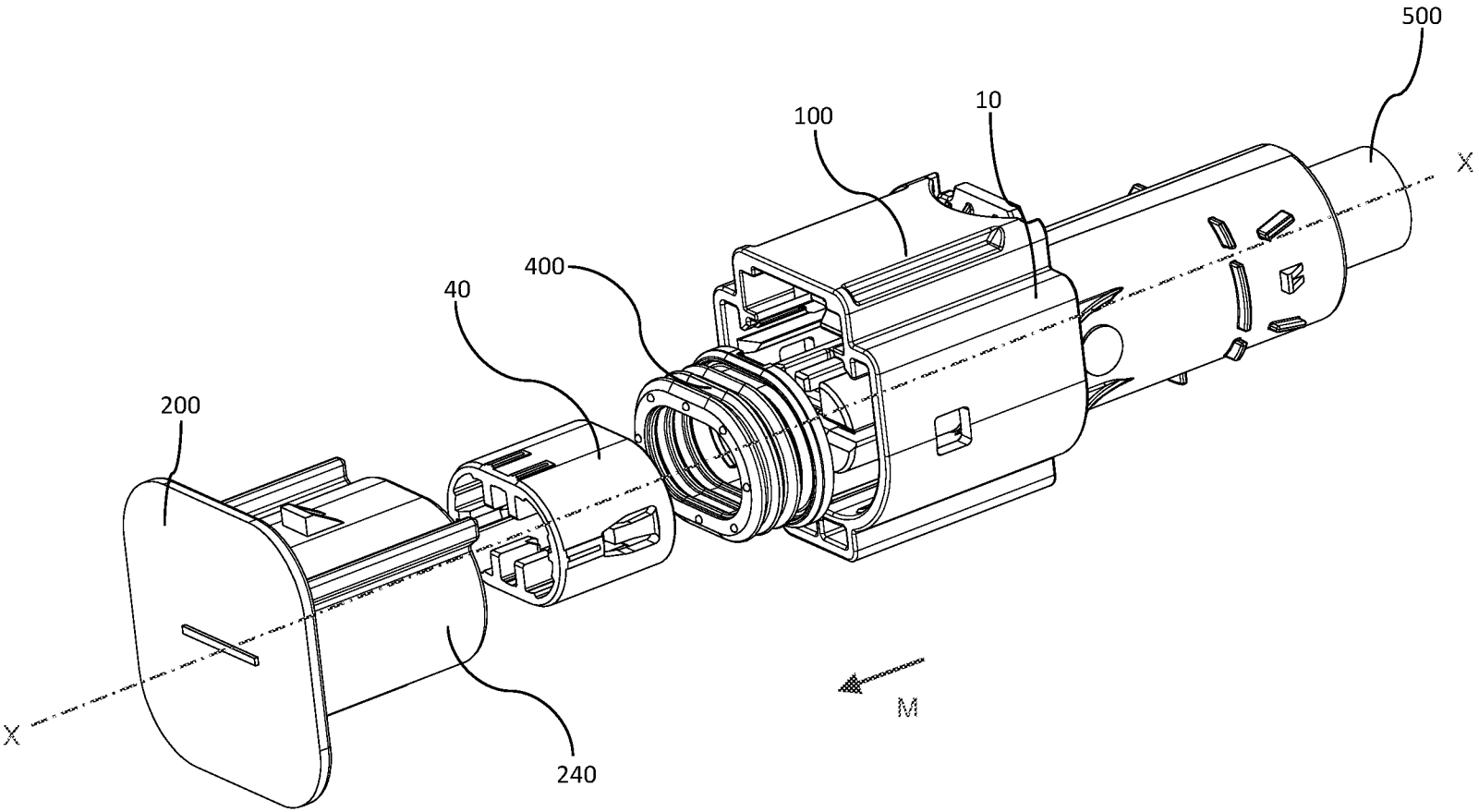
FIG. 7 is an exploded view of the electrical plug connector and the mating plug housing in accordance with an embodiment of the invention.

FIG. 7 shows, in an exploded view, the electrical plug connector 10 comprising the plug housing 100, the ring-shaped sealing element 400 and the fixing element 40, as well as the mating plug housing 200 with counter collars 240. An electric lead 500 projects out from the plug housing 100.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

I claim:

1. An electrical plug connector, comprising:

a plug housing, having a wall which has a first opening, wherein a sleeve-like contact element holder extends from the wall surrounding the first opening along a longitudinal axis in a plug-in direction, wherein a collar extends from the wall surrounding the contact element holder at a distance along the longitudinal axis in the plug-in direction, wherein a sleeve-like fixing element is detachably attached to the contact element holder, wherein the fixing element radially surrounds the contact element holder, wherein the fixing element surrounds at least a part of the contact element holder along the longitudinal axis, wherein a plurality of first protrusions project from an outer surface of the fixing element into a free space between the fixing element and the collar, wherein a plurality of second protrusions project from an inner surface of the fixing element through a plurality of second openings into the contact element holder, wherein the plurality of first protrusions and the plurality of second protrusions are designed in such a way that after fitting the plug housing together with a mating plug housing, a counter collar of the mating plug housing extends into the free space and engages there with the plurality of first protrusions, whereby the plurality of first protrusions are pressed inwards and whereby the plurality of second protrusions are pressed inwards, and wherein the plurality of second protrusions are pressed against an electrical contact element held in the contact element holder.

2. The electrical plug connector according to claim 1, wherein the sleeve-like contact element holder, the sleeve-like fixing element, and the collar each have an oval cross-section.

3. The electrical plug connector according to claim 1, wherein an inner diameter of the sleeve-like fixing element is greater than an external diameter of the sleeve-like contact element holder and wherein the external diameter of the sleeve-like fixing element is smaller than an internal diameter of the collar.

4. The electrical plug connector according to claim 1, wherein the sleeve-like fixing element is flexibly deformable in a radial direction in relation to the longitudinal axis.

5. The electrical plug connector according to claim 1, wherein a wall thickness of the sleeve-like fixing element changes along a periphery of the sleeve-like fixing element.

6. The electrical plug connector according to claim 1, wherein areas of the sleeve-like fixing element from which the plurality of first protrusions originate have a greater wall thickness.

7. The electrical plug connector according to claim 1, wherein areas of the sleeve-like fixing element from which the plurality of second protrusions originate have a greater wall thickness.

8. The electrical plug connector according to claim 1, wherein in each case one first protrusion and one second protrusion extend counter to one another along a common axis and extend away from one another at right angles to the outer surface of the sleeve-like fixing element.

9. The electrical plug connector according to claim 1, wherein the plurality of first protrusions and the plurality of second protrusions are arranged uniformly along a periphery of the sleeve-like fixing element.

10. The electrical plug connector according to claim 1, wherein the plurality of first protrusions are smaller than the plurality of second protrusions.

11. The electrical plug connector according to claim 1, wherein the sleeve-like contact element holder has a contact element chamber for holding the electrical contact element and wherein the inside of the contact element chamber is free of the plurality of second protrusions.

12. The electrical plug connector according to claim 1, wherein the plurality of second protrusions are designed as ribs, wherein the plurality of second openings are designed as slits, and wherein the slits extend counter to the plug-in direction from a free end of the sleeve-like contact element holder.

13. The electrical plug connector according to claim 1, wherein the electrical contact element is held in the sleeve-like contact element holder, wherein the electrical contact element has a rectangular cross-section, and wherein the sleeve-like contact element holder is designed to hold the electrical contact element secured against rotation relative to the longitudinal axis.

14. The electrical plug connector according to claim 13, wherein the electrical contact element has four side faces and wherein each side face of the electrical contact element is arranged respectively opposite a one second protrusion of the sleeve-like fixing element.

15. The electrical plug connector according to claim 1, wherein a ring-shaped sealing element which surrounds the sleeve-like contact element holder is arranged between the wall and the sleeve-like fixing element and wherein the sleeve-like fixing element holds the ring-shaped sealing element in position.

16. The electrical plug connector according to claim 1, wherein the sleeve-like fixing element has retaining arms which interact with retaining openings in the sleeve-like contact element holder in order to hold the sleeve-like fixing element on the sleeve-like contact element holder.

17. The electrical plug connector according to claim 1, wherein the sleeve-like contact element holder, the sleeve-like fixing element, and the collar each have a circular cross-section.

18. A method for fitting an electrical plug connector together with an electrical mating connector, comprising the steps of:

providing the electrical plug connector and the electrical mating connector;

moving the electrical plug connector along a longitudinal axis in a plug-in direction to the electrical mating connector;

inserting a counter collar of a mating plug housing of the electrical mating connector into a free space of the electrical plug connector;

moving inwards first protrusions, projecting into the free space, with the counter collar;

deforming a sleeve-like fixing element through the plurality of first protrusions attached to the sleeve-like fixing element;

moving inwards second protrusions which are attached to the sleeve-like fixing element so that the plurality of second protrusions project into the inside of a contact element holder;

clamping an electrical contact element, which is held in the electrical contact element, by the plurality of second protrusions.

* * * * *